US007967922B2

(12) United States Patent
Takayama

(10) Patent No.: US 7,967,922 B2
(45) Date of Patent: Jun. 28, 2011

(54) FERROUS ABRASION RESISTANT SLIDING MATERIAL

(75) Inventor: Takemori Takayama, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 12/654,733

(22) Filed: Dec. 30, 2009

(65) Prior Publication Data

US 2010/0108199 A1 May 6, 2010

Related U.S. Application Data

(62) Division of application No. 11/108,749, filed on Apr. 19, 2005, now abandoned.

(30) Foreign Application Priority Data

Apr. 22, 2004 (JP) ..... 2004-126270
Apr. 1, 2005 (JP) ..... 2005-105677

(51) Int. Cl.
*C22C 38/22* (2006.01)
*C22C 38/46* (2006.01)
*C22C 38/34* (2006.01)
*C22C 38/36* (2006.01)

(52) U.S. Cl. ..... 148/324; 148/334; 148/335; 148/325; 148/326; 148/328; 75/236; 75/246

(58) Field of Classification Search ..... 148/334, 148/335, 325, 326, 324, 328; 420/67–69, 420/12, 101, 102, 105, 111, 13; 75/239–241, 75/236, 246

See application file for complete search history.

(56) References Cited

U.S. PATENT DOCUMENTS

| | | | |
|---|---|---|---|
| 3,369,892 | A | 2/1968 | Ellis et al. |
| 4,513,977 | A | 4/1985 | Umeha et al. |
| 4,765,836 | A | 8/1988 | Hauser et al. |
| 4,873,150 | A | 10/1989 | Doi et al. |
| 5,085,733 | A | 2/1992 | Mitamura |
| 5,936,169 | A | 8/1999 | Pinnow et al. |
| 6,200,394 | B1 | 3/2001 | Park et al. |

FOREIGN PATENT DOCUMENTS

| | | |
|---|---|---|
| JP | 51-59007 | 5/1976 |
| JP | 59-16952 | 1/1984 |
| JP | 59-157273 | 9/1984 |
| JP | 60-50151 | 3/1985 |
| SU | 1687643 | 10/1991 |
| WO | 02/070769 | 9/2002 |

OTHER PUBLICATIONS

English Abstract of Japanese patent 363262402, Tsuyoshi Morishita et al., Oct. 28, 1988.
English Abstract of Japanese patent 357126956, Fusao Togashi et al., Aug. 6, 1982.
English Abstract of Japanese patent 360050151, Masayuki Iijima et al., Mar. 19, 1985.

*Primary Examiner* — Deborah Yee
(74) *Attorney, Agent, or Firm* — Wenderoth, Lind & Ponack, L.L.P.

(57) ABSTRACT

A ferrous abrasion resistant sliding material capable of improving seizing resistance, abrasion resistance and heat crack resistance is provided. The ferrous abrasion resistant sliding material has a martensite parent phase which forms a solid solution with carbon of 0.15 to 0.5 wt %, and the martensite parent phase contains one or more types of each special carbide of Cr, Mo, W and V dispersed therein in a total content of 10 to 50% by volume.

7 Claims, 11 Drawing Sheets

FERROUS ABRASION RESISTANT SLIDING MATERIAL

This application is a divisional application of U.S. application Ser. No. 11/108,749, filed Apr. 19, 2005, now abandoned.

FIELD OF THE INVENTION

The present invention relates to a ferrous abrasion resistant sliding material suitable for use in a sliding surface which slides under a bad lubricating condition of a trust bearing of a connecting device, or a floating seal of a reduction gear or a roller.

BACKGROUND OF THE INVENTION

A track roller assembly and a reduction gear apparatus of a construction machine are equipped with a ferrous floating seal for the purpose of preventing leakage of lubrication oil from inside thereof as well as entering of earth and sand therein. Accordingly, such a floating seal is widely produced by applying an adequate treatment in which a seal sliding surface thereof is quenched to have a hard martensite structure, or a large amount of hard cementite and $Cr_7C_3$ carbide are crystallized in 30% by volume while causing a parent phase to a martensite by quenching, in order to improve seizing resistance and abrasion resistance. Such an exemplary floating seal is made by using a low-alloy steel containing carbon of 0.8 wt %, a Ni-Hard cast iron or a high-carbon and high-Cr cast iron (for example, as shown in Japanese Patent Publication (KOKAI) No. S51-59007).

In addition, a ferrous floating seal member in which abrasion-resistant material is splayed to a seal sliding surface thereof is sometime used for some purposes.

In the ferrous floating seal used for sealing a lubricating oil in the reduction gears and the rollers, a seal sliding surface thereof is abraded as fine particles of earth and sand are entered on the seal sliding surface by hulling motion in the earth and sand, and is lubed with the sealed lubrication oil therein. Accordingly, a ferrous floating seal capable of withstanding a very severe lubrication condition is required. Even in a case of a most conventionally used hard ferrous floating seal made of a high-carbon and high-Cr cast iron, when setting pressure (press force) at assembling is high, considerable quenching crack (heat crack), seizing and abnormal abrasion occur on the seal sliding surface, resulting in leakage of oil.

And, even if various tool steels such as a cold work tool steel and a high speed steel (SKH material) excellent in seizing resistance are used for a floating seal, seizing caused by defect of seizing resistance and heat crack resistance easily occurs and abrasion resistance is insufficient. In addition, such steels are expensive, resulting in problem that a material cost increases in view of material yields before a product is finished.

Furthermore, in resent years, a construction machine such as a bulldozer is required to be driven at a high speed for improvement in working efficiency, and therefore, the ferrous floating seal necessarily rotates at a high speed. This also causes quenching crack, seizing and abnormal abrasion, resulting in leakage of oil.

And, a thrust bearing and a radial bearing which slides at a low speed under a high surface pressure with a severe lubricating condition of such as a bearing of a construction machine has problems in seizing, abnormal abrasion and abnormal noise. Accordingly, a ferrous abrasion resistant sliding material suitable for use in a reduction gear, a track roller and a bearing of the construction machine is required for the purpose of improving seizing resistance and preventing abnormal abrasion at sliding, and extending the abrasion resistant life.

In order to solve the above-mentioned problems, an object of the present invention is to provide a ferrous abrasion resistant sliding material capable of improving seizing resistance, abrasion resistance and heat track resistance.

SUMMARY OF THE INVENTION

A ferrous abrasion resistant sliding material in the present invention has a martensite parent phase which forms a solid solution with carbon of 0.15 to 0.5 wt %, wherein the martensite parent phase contains one or more types of each special carbide of Cr, Mo, W and V dispersed therein in a total content of 10 to 50% by volume.

In the present invention, it is preferable that a ferrous abrasion resistant sliding material contains one or more elements of Cr of 6.5 wt % or more, Mo of 3.5 wt % or more and V of 3 wt % or more, and the martensite parent phase contains one or more special carbides of $Cr_7C_3$-type carbide, $M_6C$-type carbide and MC-type carbide dispersed therein.

As described above, in the present invention, a ferrous abrasion resistant sliding material capable of improving seizing resistance, abrasion resistance and heat crack resistance can be provided.

BRIEF DESCRIPTION OF THE DRAWINGS

FIG. 4 is a phase diagram of a Fe—Si—C—X quaternary alloy.

DETAILED DESCRIPTION OF EMBODIMENT OF THE INVENTION

Figure 1:
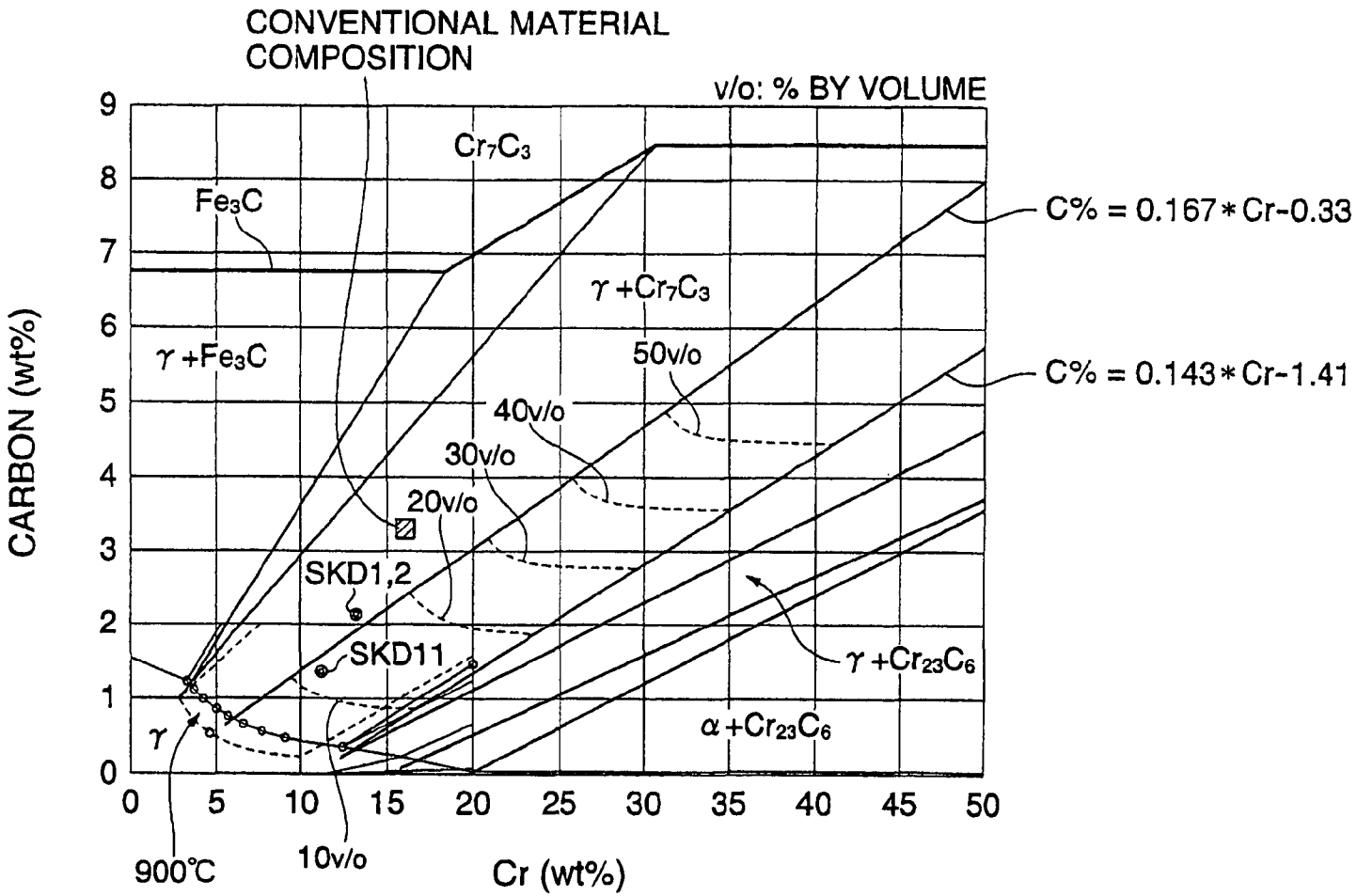
FIG. 1 is a phase diagram of a Fe—C—Cr ternary alloy (at 1000° C.).

In the present invention, a ferrous abrasion resistant sliding material has a parent phase, taking the form of a martensite phase formed by rapidly cooling from a austenite phase, in which a solid soluble concentration of carbon is maintained at as small as 0.15 to 0.5 wt % so as to improve heat crack resistance. In addition, the material has a structure in which one or more types of each special carbide of Cr, Mo, W and V is dispersed with directivity in a total content of 10 to 50% by volume so as to improve seizing resistance and abrasion resistance.

In order to form a martensite phase excellent in heat crack resistance, in terms of a concentration of carbon contained in a low-carbon martensite excellent in toughness and quenching crack resistance during a heat treatment and also a concentration of carbon contained in a hot work tool steel (SKD6, SKD7, SKD61, SKD62, SKD8 and 3Ni-3Mo steel) which requires high heat crack resistance without dispersing carbide, in the present invention, the upper limit of a concentration of carbon which forms a solid solution with a martensite parent phase is set at 0.5 wt % and the lower limit thereof is set at 0.15 wt %. And, in order to improve abrasion resistance to earth and sand, the martensite parent phase preferably has Rockwell hardness C scale (HRC) of 50 or more. In addition, in order to ensure stable heat crack resistance, it is preferable that a concentration of carbon, which forms a solid solution with the martensite parent phase, is adjusted to 0.2 to 0.45 wt %.

As described above, a content of the special carbide dispersed in the martensite parent phase is set within the range of 10 to 50% by volume. The reason that the lower limit of a content of the special carbide to be dispersed is set at 10% by volume is that a high-speed steel excellent in abrasion resistance is prepared so as to contain carbide in 10% or more by volume, in addition, in order to improve seizing resistance withstanding a severe lubricating condition and more improve abrasion resistance and seizing resistance to earth and sand. In order to more improve seizing resistance, it is effective that a large amount of hard carbide, nitride, carbonitride and oxide are dispersed in a martensite phase, for example, a high-carbon and high-Cr cast iron contains carbide dispersed and precipitated therein in 50% by volume. Accordingly, the upper limit of thereof is set at 50% by volume. If a content of special carbide dispersed therein exceeds 50% by volume, a casting floating seal becomes brittle excessively. Accordingly, when a ferrous abrasion resistant sliding material is used for a floating seal member necessary for abrasion resistance, it is preferable that a content of special carbide dispersed therein is set at 10 to 50% by volume.

In order to adjust a concentration of carbon, which forms a solid solution with the martensite parent phase, easily and disperse harder carbide in the martensite parent phase, a ferrous abrasion resistant sliding material according to the present invention contains at least one or more elements of Cr of 6.5 wt % or more, Mo of 3.5 wt % or more and V of 3 wt % or more, and contains one or more carbides of inexpensive $Cr_7C_3$-type carbide, $M_6C$-type carbide excellent in toughness and very hard MC-type carbide dispersed therein. And, from an economical viewpoint, it is more preferable that $Cr_7C_3$-type carbide and one or more carbides of $M_6C$-type carbide and MC-type carbide are dispersed therein.

Table 1 shows a typical composition of a high-carbon and high-Cr cast iron conventionally used for an abrasion resistant sliding material for a floating seal, and compositions of high-carbon and high-Cr work tool steels such as SKD1, SKD2 and SKD11. FIG. 1 is a phase diagram of a Fe—C—Cr ternary alloy at a suitable quenching temperature of the irons of 900 to 1000° C. In the figure, each composition of carbon and Cr of the cast iron and the steels are represented. The figure shows that, in each case, a martensite parent phase, which forms a solid solution of carbon of 0.5 to 1.1 wt %, contains $Cr_7C_3$-type carbide dispersed therein in a content of 10 to 40% by volume. Such abrasion resistant sliding materials have insufficient heat crack resistance. Accordingly, in the present invention, a ferrous abrasion resistant sliding material contains at least carbon of 1.5 to 4.5 wt % and Cr of 10 to 40 wt %, with each amount being satisfied the following equation;

$0.143\times Cr(wt\ \%)-1.41 \leqq carbon(wt\ \%) \leqq 0.167\times Cr(wt\ \%)-0.33$, and, has a structure in which a martensite phase, which forms a solid solution of carbon of 0.2 to 0.45 wt %, contains $Cr_7C_3$-type carbide dispersed therein in a content of 10 to 50% by volume. And, the material further contains one or more elements of Si, Mn, Ni, P, S, B, N, Mo, V, Ti, W, Co, Cu and Al if necessary. In order to more improve abrasion resistance, it is preferable that $Cr_7C_3$-type carbide is dispersed in a content of 20 to 50% by volume.

TABLE 1

ABRASION RESISTANT STEELS AND CAST IRONS (wt %)

| | No. | C | Si | Mn | Ni | Cr | Mo | V | W |
|---|---|---|---|---|---|---|---|---|---|
| SKD1 | A1 | 2.02 | 0.3 | 0.43 | | 12.48 | | | |
| SKD2 | A2 | 2.1 | 0.2 | 0.45 | | 13.5 | | | 2.9 |
| SKD11 | A3 | 1.54 | 0.2 | 0.35 | | 11.32 | 0.91 | 0.28 | |
| $FC_{15}Cr_3Mo$ | A4 | 3.5 | 1.6 | 0.51 | 1.67 | 15.7 | 2.5 | 0.45 | |

It is not preferred in terms of abrasion resistance and seizing resistance that a martensite phase in a sliding surface softens to have hardness of HRC50 or less by heat generation of the sliding surface under a boundary lubricating condition. Accordingly, in the present invention, a ferrous abrasion resistant material has a martensite parent phase which contains one or more elements of Mo of 0.5 to 4 wt %, W of 0.5 to 4 wt % and V of 0.05 to 0.6 wt % so as to be able to maintain hardness of HRC50 or more, more preferably HRC55 or more, at tempering at 600° C. The upper limit of each amount of Mo and W to be contained is set at 4 wt % so as to enhance tempering-softening resistance of the martensite parent phase and accommodate to a quenching temperature of 900 to 1000° C., however, it is preferably set at 2.5 wt %, because tempering-softening resistance is enhanced remarkably. In the present invention, in light of an amount of Mo which is concentrated in $Cr_7C_3$-type carbide dispersed in a martensite phase, the upper limit thereof is set at 4 wt %. The lower limit thereof is not limited, however, it is preferably set at 0.5 wt %, more preferably 1.5 wt %, in view of the hot work tool steel.

As a result of studying V as Mo and W as well, V has a maximum solid soluble concentration with a martensite parent phase of about 0.6 wt %, and is concentrated in $Cr_7C_3$-type carbide remarkably. Accordingly, V of as large as about 3.5 wt % can be added to a ferrous abrasion resistant sliding material without precipitation of MC-type carbide. Accordingly, it is preferable that the lower limit of a content of V in the martensite parent phase is set at 0.05 wt %, because tempering-softening resistant performance begins to be demonstrated remarkably. And, assuming a ferrous abrasion resistant sliding material containing $Cr_7C_3$-type carbide of 5 to 40 wt % dispersed therein, it is preferable that an amount of V to be added is set at 0.5 to 3 wt %.

When a ferrous abrasion resistant sliding material is used for a floating seal which requires more superior abrasion resistance, in order to enhance abrasion resistance, in the present invention, a ferrous abrasion resistant sliding material contains at least one or more elements of carbon of 2.25 to 4.5 wt %, Cr of 6.5 to 35 wt % and (V+Ti) in a total amount of 3 to 8 wt %, with each amount being satisfied the following equation;

$0.143\times Cr(wt\ \%)-1.41+0.2\times(V(wt\ \%)-0.5+Ti(wt\ \%))\leqq carbon(wt\ \%)\leqq 0.167\times Cr(wt\ \%)-0.33+0.2\times(V(wt\ \%)-0.5+Ti(wt\ \%))$, and, a martensite parent phase, which forms a solid solution with carbon of 0.2 to 0.5 wt %, contains $Cr_7C_3$-type carbide and MC-type carbide harder than the $Cr_7C_3$-type carbide dispersed therein. In such a case, in terms of toughness of the ferrous abrasion resistant sliding material, it is preferable to precipitate and disperse $Cr_7C_3$-type carbide and MC-type carbide in a content of 10 to 40% by volume and in a content of 5 to 15% by volume, respectively, with a total content thereof being 15 to 50% by volume. In addition, the material further may contain one or more elements of Si, Mn, Ni, P, S, B, N, Mo, W, Co, Cu and Al.

In the present invention, MC-type carbide is precipitated and dispersed in 15% by volume at the maximum by adding V and Ti. Accordingly, it is necessary that carbon of an amount of $0.2\times(V(wt\ \%)-0.5+Ti(wt\ \%))$, in which V(wt %) and Ti(wt %) represent an addition amount of V and Ti, respectively, is additionally added to the ferrous abrasion resistant sliding material.

A high-speed steel such as CKH2, SKH10, SKH54 and SKH57 having high hardness is quenched from a quenching temperature of at least 1200° C. or more. So, in the normal quenching condition (a quenching temperature of 1200° C. or more), a martensite parent phase contains $M_6C$-type carbide having a crystal structure of $Fe_3W_3C$ and MC-type carbide having a crystal structure of $V_4C_3$ or WC precipitated and dispersed therein in a content of 5 to 12% by volume and in a content of 1 to 9% by volume, respectively, with a total content of the carbides being 7 to 12% by volume. At this time, a concentration of carbon, which forms a solid solution with the martensite parent phase, is set at 0.5 to 0.6 wt %. Therefore, heat crack resistance and abrasion resistance are insufficient as similar to the high-carbon and high-Cr work tool steel.

Accordingly, in the present invention, a ferrous abrasion resistant sliding material contains at least carbon of 0.6 to 1.9 wt %, Cr of 1 to 7 wt %, V of 0 to 3 wt %, Mo of 3.5 wt % or more and (Mo+0.5×wt %) of 6 to 25 wt %, in which 0.5×W represents half of a real amount of W, with each amount being satisfied the following equation;

$0.05\times(Mo(wt\ \%)+0.5\times W(wt\ \%))\leqq carbon(wt\ \%)\leqq 0.038\times(Mo(wt\ \%)+0.5\times W(wt\ \%))+0.42$, and, a martensite parent phase, which forms a solid solution with carbon of 0.2 to 0.5 wt %, contains $M_6C$-type carbide and MC-type carbide dispersed therein in a content of 5 to 40% by volume and in a content of 5% or less by volume, respectively. In addition, the material preferably contains one or more elements of Si, Mn, Ni, P, S, B, N, V, Ti, Co, Cu and Al if necessary.

The $M_6C$-type carbide precipitated in the ferrous abrasion resistant sliding material is a carbide which forms a high-speed steel mainly, and has excellent high-temperature hardness higher than the $Cr_7C_3$-type carbide. And, it has a face centered cubic crystal, and has excellent toughness. In addition, the $M_6C$-type carbide contains Mo and W in a high density and improves seizing resistance at sliding remarkably. Accordingly, in the present invention, a ferrous abrasion resistant sliding material contains $M_6C$-type carbide mainly so as to improve seizing resistance. When the material is used for a floating seal which requires superior abrasion resistance, it is preferable that (Mo+0.5×W) of 8 to 25 wt %, in which 0.5×W represents half of a real amount of W, is added so that the material can contain $M_6C$-type carbide dispersed therein in a content of 20% or more by volume.

In the present invention, in order to adjust a concentration of carbon which forms a solid solution with a martensite parent phase, referring to a phase diagram of a Fe—C—Mo ternary alloy at 900 to 1000° C. (FIG. 2) and a phase diagram of a Fe—C—W ternary alloy (FIG. 3), an amount of carbon added to a ferrous abrasion resistant sliding material is regulated according to the following equation using each addition amount of Mo, W and V;

$0.05\times(Mo(wt\ \%)+0.5\times W(wt\ \%))\leqq carbon(wt\ \%)\leqq 0.038\times(Mo(wt\ \%)+0.5\times W(wt\ \%))+0.42$, so that a concentration of carbon, which forms a solid solution with the martensite parent phase, will be adjusted to 0.2 to 0.5 wt %.

In order to enhance abrasion resistance to entering earth and sand higher than a high-speed steel, it is preferable that a ferrous abrasion resistant sliding material contains at least carbon of 1.3 to 3 wt %, Cr of 1 to 7 wt %, V of 3 to 8 wt %, Mo of 3.5 wt % or more and (Mo+0.5×W) of 7 to 25 wt %, in which 0.5×W represents half of a real amount of W, with each amount being satisfied the following equation;

$0.05\times(Mo(wt\ \%)+0.5\times W(wt\ \%))+0.2\times(V(wt\ \%)-0.5+Ti(wt\ \%))\ carbon(wt\ \%)\leqq 0.038\times(Mo(wt\ \%)+0.5\times W(wt\ \%))+0.42+0.2\times(V(wt\ \%)-0.5+Ti(wt\ \%))$, and has a structure in which a martensite parent phase, which forms a solid solution of carbon of 0.2 to 0.45 wt %, contains $M_6C$-type carbide and MC-type carbide dispersed therein in a content of 10 to 40% by volume and in a content of 5 to 15% by volume, respectively. And, the material further contains one or more elements of Si, Mn, Ni, P, S, B, N, V, Ti, Co, Cu and Al. More preferably, the material contains Mo of 7 wt % or more and (Mo+0.5×W) of 10 to 20 wt %, in which 0.5×W represents half of a real amount of W, so that a content of $M_6C$-type carbide and MC type carbide dispersed therein will increase to 20 to 40% by volume, causing improvement in abrasion resistance and seizing resistance higher than a conventional high-speed steel.

A ferrous abrasion resistant sliding material containing Mo and W mainly is not preferred in an economical viewpoint compared with a ferrous abrasion resistant sliding material containing $Cr_7C_3$-type carbide dispersed therein mainly. Accordingly, in the present invention, it is preferable that a ferrous abrasion resistant sliding material contains at least carbon of 1.5 to 3 wt %, Cr of 7 to 25 wt %, and (Mo+0.5×W) of 6 to 15 wt %, in which 0.5×W represents half of a real amount of W, with each amount being satisfied the following equation;

$0.043\times(Mo(wt\ \%)+0.5\times W(wt\ \%))+2\times 0.085\times(Cr(wt\ \%)-5)\leqq carbon(wt\ \%)\leqq 0.038\times(Mo(wt\ \%)+0.5\times W(wt\ \%))+0.42+2\times 0.085\times(Cr(wt\ \%)-5)$, and a martensite parent phase, which forms a solid solution with carbon of 0.2 to 0.5 wt %, contains $Cr_7C_3$-type carbide and $M_6C$-type carbide precipitated and dispersed therein in a content of 5 to 25% by volume and in a content of 5 to 25% by volume, respectively, with a total content of the carbide being 10 to 50% by volume. And, the material preferably contains one or more elements of Si, Mn, Ni, P, S, B, N, V, Ti, Co, Cu and Al if necessary. In order to more improve abrasion resistance, it is preferable that a total content of the aforesaid carbide is adjusted to 20 to 50% by volume.

Furthermore, in order to improve abrasion resistance and toughness, in the present invention, a ferrous abrasion resistant sliding material contains carbon of 1.5 to 3.2 wt %, Cr of 7 to 25 wt %, (Mo+0.5×W) of to 15 wt %, in which 0.5×W represents half of a real amount of W, and (V+Ti) of 3 to 8 wt %, with each amount being satisfied the following equation;

$0.043\times(Mo(wt\ \%)+0.5\times W(wt\ \%))+2\times 0.085\times(Cr(wt\ \%)-5)+0.2\times(V(wt\ \%)-0.5+Ti(wt\ \%))\leqq carbon(wt\ \%)\leqq 0.038\times(Mo(wt\ \%)+0.5\times W(wt\ \%))+0.42+2\times 0.085\times(Cr$ (wt %)−5)+0.2×(V(wt %)−0.5+Ti(wt %)), and a martensite parent phase, which forms a solid solution with carbon of 0.2 to 0.5 wt %, contains $Cr_7C_3$-type carbide, $M_6C$-type carbide and MC-type carbide dispersed therein in a content of 5 to 25% by volume, in a content of 5 to 25% by volume and in a content of 5 to 15% by volume, respectively, with a total content of the carbide being 15 to 50% by volume. And, the material preferably contains one or more elements of Si, Mn, Ni, P, S, B, N, V, Ti, Co, Cu and Al. This allows obtaining a hard ferrous abrasion resistant sliding material.

In the present invention, in order to improve seizing resistance, it is preferable that a ferrous abrasion resistant sliding material contains P of 0.2 to 1.5 wt % dispersed therein so as to disperse one or more types of each phosphide (for example, $Fe_3P$-type, $Cr_2P$-type, FeMoP-type, $V_2P$-type and FeTiP-type) enriched with each of Cr, Mo, W and V, increasing seizing resistance, in a total content of 0.5 to 10% by volume. An addition of P of 0.2 wt % improves fluidity of a ferrous abrasion resistant sliding material during casting remarkably, however, an excessive addition of P causes brittleness. Accordingly, the upper limit of an amount of P to be added is set at 1.5 wt % and the lower limit thereof is set at 0.2 wt %.

In order to improve seizing resistance of the ferrous abrasion resistant sliding material, it is important to enhance tempering-softening resistance of a martensite parent phase thereof. Accordingly, in the present invention, it is preferable that a ferrous abrasion resistant sliding material contains one or more elements of Si, Al, Ni and Co in an amount of 2 to 15 wt %.

Si forms a solid solution with a martensite phase in a large amount, enhancing tempering-softening resistance of the martensite phase. And, Si is an inexpensive element. So, Si has been positively added to a hot work tool steel, such as SKD6, SKD61 and SKD62, which does not contain carbide dispersed therein. In the present invention, it is preferable that Si of 0.5 to 3.5 wt % is added. Al has seldom added to the hot work tool steel, however, has remarkable tempering-softening resistance as well as Si so that it is preferable to be added positively. And, Ni and Co cause age-hardenability when coexists with Al, Si and Mo. Especially, Co increases a magnetic transformation temperature of iron remarkably and suppresses diffusion of an alloy element so as to enhance tempering-softening resistance of a martensite phase, whereby it is preferable to be added positively. However, in the present invention, the upper limit of an addition amount of Co is set at 10 wt % from an economical viewpoint.

Furthermore, in a ferrous abrasion resistant sliding material, Si increases carbon activity in an austenite phase at quenching and decrease a concentration of carbon, which forms a solid solution with a martensite phase, at a relation of 0.1×Si(wt %), causing improving heat crack resistance. In the present invention, it is preferable that a ferrous abrasion resistant sliding material contains Si of at least 0.5 to 3.5 wt % so that a suitable range of a concentration of carbon in the ferrous abrasion resistant sliding material will be adjusted to be higher at a relation of 0.1×Si(wt %).

Figure 4A:
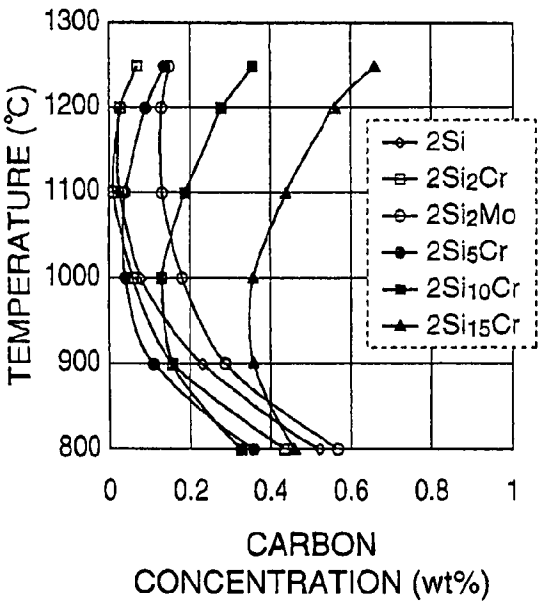
FIG. 4A is a phase diagram $\gamma/(\alpha+\gamma)$ of $Fe_2Si$.
Figure 4B:
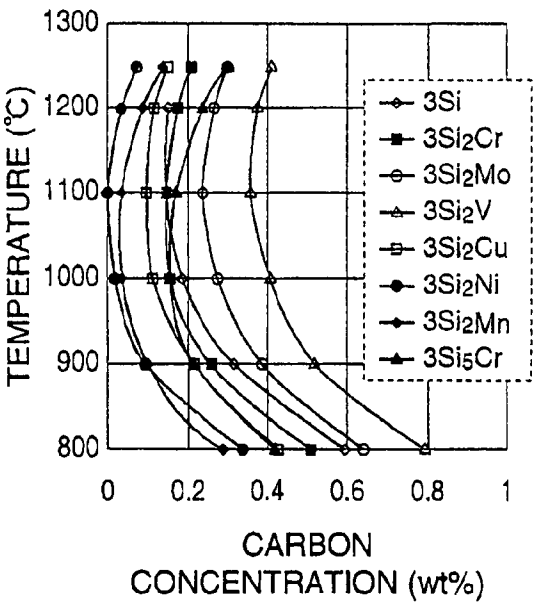
FIG. 4B is a phase diagram $\gamma/(\alpha+\gamma)$ of $Fe_3Si$.
Figure 4C:
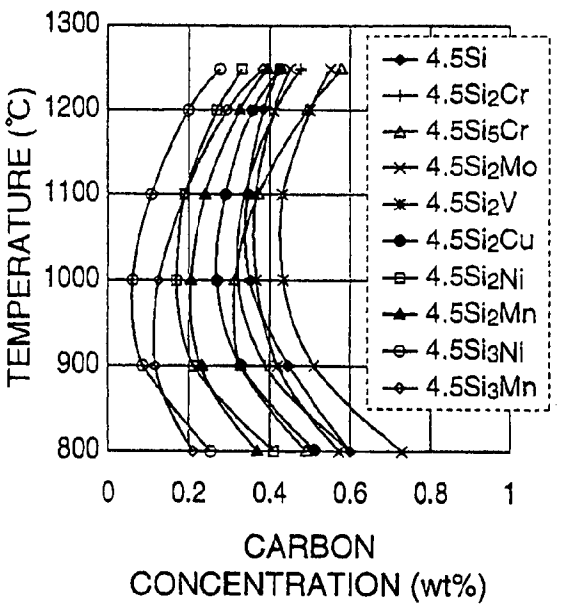
FIG. 4C is a phase diagram $\gamma/(\alpha+\gamma)$ of $Fe_{4.5}Si$.

In addition, Si stabilizes a Fe phase remarkably and moves A1 and A3 transformation temperatures to higher so that it will be expected to enhance heat crack resistance of a sliding surface. And, as shown a A3 transformation temperature change per unit weight (wt %) of each alloy element (ΔA3=° C./wt %, Si:+40, Al:+70, Mo:+20, V:+40, W:+12, Mn:−30, Ni:−15 and C:−220), Al, Mo, V and W in addition to Si enhance heat crack resistance. However, if Si and these alloy elements coexist in a large amount, a ferrite phase is more stabilized, whereby a suitable quenching treatment cannot be achieved. Accordingly, in the present invention, the upper limit of an addition amount of Si is set at 3.5 wt %, because, in view of a thermodynamically calculated phase diagram of a Fe—Si—C—X quaternary alloy shown in FIG. 4A, FIG. 4B and FIG. 4C, considering a composition (carbon of 0.45 wt % and Cr of 5 wt %) of a martensite parent phase containing $Cr_7C_3$-type carbide dispersed therein mainly, an addition of Si of 3.5 wt % is permitted. And, considering a composition (carbon of 0.45 wt %, Mo of 3 wt % and V of 0.5 wt %) of a martensite parent phase containing $M_6C$-type carbide dispersed therein mainly, the upper limit of an addition amount of Si is set at 2.5 wt % (referred to FIG. 4A, FIG. 4B and FIG. 4C). And, since Si improves tempering-softening resistance of a martensite parent phase, the lower limit thereof is set at 0.5 wt % at which the tempering-softening resistance improving effect is demonstrated clearly.

When Si of 0.5 to 3.5 wt % is added or Mo and W are added in a large amount, in order to move a quenching temperature to lower, it is preferable that Ni and Mn, causing stabilization of an austenite phase, is added so that A1 and A3 transformation temperatures will move to lower. At this time, it is preferable that at least either one of Ni of 1 to 6 wt % or Mn of 0.5 to 2 wt % is added (referred to FIG. 4A, FIG. 4B and FIG. 4C). And, it is preferable that Ni is added coexistent with Al because age-hardenability becomes remarkable by a precipitation of an intermetallic compound and toughness is improved.

And, a martensite parent phase containing Al of 3 to 15 wt % and having $Fe_3Al$ order transformation is improved in seizing resistance remarkably. Accordingly, in the present invention, a ferrous abrasion resistant sliding material has such a martensite parent phase.

In order to improve heat crack resistance, in the present invention, it is preferable that a ferrous abrasion resistant sliding material contains soft copper alloy phase dispersed therein in a content of 1 to 10% by volume. This enables to enhance conformability of a sliding surface and form a partial oil pocket during sliding easily. At this time, it is preferable from a corrosion resistant viewpoint that the copper alloy phase contains one or more elements of Si, Al and Ni so as to improve sliding performance.

For the purpose of strengthening, it is also preferable that a ferrous abrasion resistant sliding material contains tempered martensite phase, which is quenched from 900 to 1000° C. and tempered at 150 to 600° C., and further contains at least retained austenite phase in a content 30% or less by volume. In order to improve conformability of a sliding surface, it is preferable that the martensite phase is tempered at 150 to 450° C. and the material contains retained austenite in a content of 10 to 30% by volume.

In a large diameter floating seal used for a reduction gear apparatus, a diameter of the seal ring becomes so large that a sliding rate of the seal surface becomes high. Accordingly, a floating seal ring excellent in higher seizing resistance and higher heat crack resistance is required. In order to obtain such a floating seal ring, in a casting floating seal using a ferrous abrasion resistant sliding material according to the present invention, it is preferable from a viewpoint of strength that a content of special carbide to be dispersed is adjusted to 20 to 50% by volume. And, the casting floating seal is preferably produced by a centrifugal casting method, as a result, carbide dispersed therein can have high directivity by increasing a cooling rate during casting, seizing resistance does not decrease and copper alloy phase can be finely dispersed.

In order to strengthen, it is preferable that the floating seal is treated in such a manner that a surface layer of a sliding surface thereof is at least carburized or carbonitrided so as to have the same composition as any one of the aforesaid ferrous abrasion resistant sliding materials. Such the carburized floating seal having a structure excellent in strength and toughness is superior at the point that special carbide precipitated by carburizing can be densely dispersed in the surface layer of the sliding surface in a content of as large as 20 to 70% by volume. And, a ferrous abrasion resistant sliding material is used for a floating seal member, in which a sliding surface thereof is at least carburized or carbonitrided so that a surface layer of the sliding surface will have a structure in which a martensite parent phase, which forms a solid solution with carbon of 0.2 to 0.5 wt %, contains the special carbide dispersed therein in a content of 20 to 70% by volume.

From the viewpoint of producing cost, since a ferrous abrasion resistant sliding material according to the present invention is soft and therefore has good machineability before carburizing, it is becomes possible that the material is inexpensively machined by combination of casting, plastic forming, bending forming, welding and the like.

Referring now to the drawings, there will be explained preferred embodiments of the invention.

Figure 5:
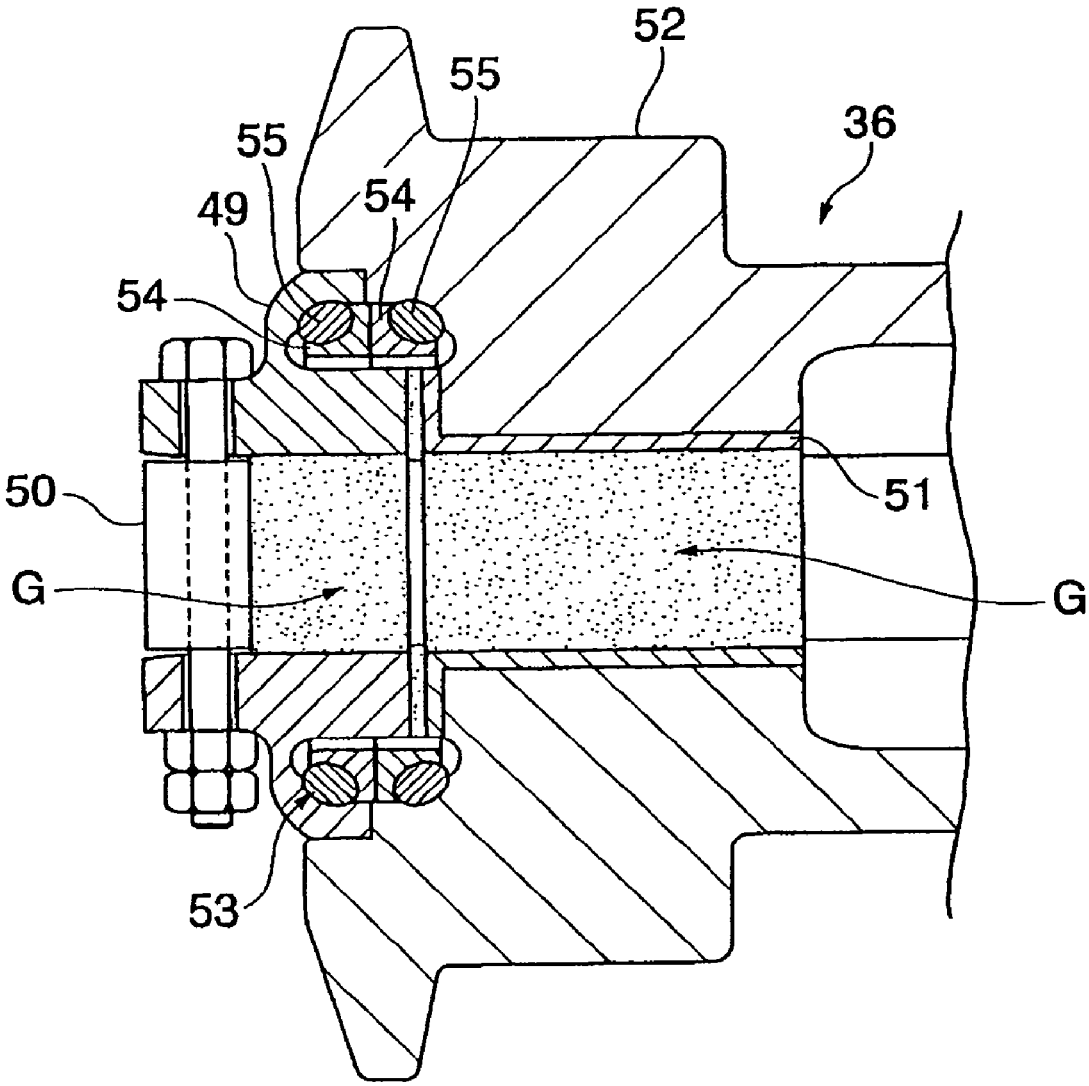
FIG. 5 is a drawing showing a principal part of a roller assembly according to one embodiment of the present invention.

FIG. 5 is a drawing showing a principal part of a roller assembly according to one embodiment of the present invention. This embodiment shows a floating seal equipped with the roller assembly.

The roller assembly 36, according to the embodiment, has a roller retainer 49, a roller shaft 50 supported by the retainer 49 and a roller bushing (collar bushing) 51 fitted onto the shaft 50 and a roller 52 arranged through the bushing 51, which are rotatably connected each other. A floating seal device 53 is provided with one pair of seal rings 54 with seal surfaces contacted each other and an O-ring 55 fitted onto each of the seal ring 54. In the roller assembly 36, the floating seal device 53 is arranged such that the contacted seal surfaces of the seal rings 54 are pressed toward the shaft 50 by elastic force of the compressed O-rings 55. The seal surfaces are relatively slidable while being pressed each other at an adequate pressure so as to prevent entering water or earth and sand from outside, as well as preventing leakage of lubricating oil from inside. The seal surface of the seal rings 54 has a structure in which carbide in a content of at least 5 to 45% by volume and at least either one of graphite or copper alloy particles are dispersed in a hard martensite parent phase.

According to the present invention, a floating seal device excellent in seizing resistance and heat crack resistance can be provided. Furthermore, from a viewpoint of strength, it is preferable that a content of special carbide dispersed therein is adjusted to 20 to 50% by volume. And, a floating seal member is preferably produced by a centrifugal casting method, because carbide dispersed therein can have high directivity by increasing a cooling rate during casting, seizing resistance does not decrease, and copper alloy phase can be finely dispersed. In order to more strengthen, a sliding surface of the floating seal member is at least carburized or carbonitrided so as to contain carbon, Cr, V, W and Mo each having an adjusted content. Such a carburized floating seal member having a structure excellent in strength and toughness is superior at the point that special carbide precipitated by carburizing can be densely dispersed in a surface layer of a sliding surface in a content of as large as 20 to 70% by volume.

Next, a ferrous abrasion resistant sliding material according to the present invention will be described in detail with reference to the accompanying drawings.

EXAMPLE 1

Equilibrium Composition of a Ferrous Abrasion Resistant Sliding Material

In order to analyze an equilibrium composition of a ingot ferrous abrasion resistant sliding material by using an X-ray micro analyzer, in this example, sintered alloys having easily adjustable composition were prepared. Specifically, in this example, three kinds of sintered mixed alloy powder A, B and C, as shown in Table 2, were prepared in such a manner that each powder of Ni, Co, Si, FeAl and FeP having a grain size under #350 mesh and graphite powder having an average grain size of 6 μm or less were mixed to an alloy powder containing iron, carbon of 0.6 wt %, Si of 0.3 wt %, Mn of 0.45 wt %, Cr of 15 wt %, Mo of 3 wt % and V of 1.2 wt %, and another alloy powder containing iron, carbon of 0.6 wt %, Si of 0.3 wt %, Mn of 0.35 wt %, Cr of 9 wt %, Mo of 6 wt %, W of 4 wt % and V of 2 wt %. Then, each of the prepared sintered mixed alloy powders to which paraffin wax of 3 wt % was added was press molded at a pressure of 1 ton/cm$^2$ to prepared a molded articles each having a composition A, B and C, respectively. Next, the molded articles each having a composition A and B, respectively, were vacuum sintered at 1190° C. for two hours, and the molded article having a composition C was vacuum sintered at 1135° C. for two hours. Then, after cooling in the furnace to 1000° C., each of the molded articles was cooling quenched under nitrogen gas atmosphere at a pressure of 400 torr, and then abrasive machining was applied to a cut surface thereof. The cut surface of each of the molded articles were analyzed by using an X-ray micro analyzer (EPMA, Electron Probe Microanalyzer) so as to obtain each concentration of alloy elements contained in a martensite parent phase and contained in carbide precipitated in the martensite parent phase. The analysis is shown in Table 2.

TABLE 2

| | | CONCENTRATIONS OF ALLOY ELEMENTS (wt %) | | | | | | | | | |
|---|---|---|---|---|---|---|---|---|---|---|---|
| | No. | PHASE AND K | C | Si | Al | Cr | Mo | V | W | Ni | Co |
| $Fe_3C_{15}Cr_3Mo_3Co$ | A | PARENT PHASE | 0.4 | 0.8 | 0.9 | 6.2 | 2.1 | 0.27 | | 2.1 | 4 |
| | | $M_7C_3$ | 8.45 | 0.04 | 0.02 | 40 | 4.9 | 4.7 | | 0.2 | 0.9 |
| | | $KM_7$ | | 0.05 | 0.02 | 6.45 | 2.33 | 17.41 | | 0.10 | 0.23 |
| $Fe_3C_{15}Cr_3Mo_4Ni$ | B | PARENT PHASE | 0.43 | 0.86 | | 7.12 | 2.16 | 0.34 | | 5.2 | |
| | | $M_7C_3$ | 8.42 | 0.03 | | 39.9 | 4.96 | 4.67 | | 0.36 | |
| | | $KM_7$ | | 0.03 | | 5.60 | 2.30 | 13.74 | | 0.07 | |
| $Fe_3C_9Cr_6Mo_4W$ | C | PARENT PHASE | 0.44 | 0.85 | | 4.27 | 1.52 | 0.37 | 1.23 | 5.33 | 4.96 |
| | | $M_7C_3$ | 7.61 | 0.04 | | 27.7 | 3.72 | 6.79 | 3.61 | 0.49 | 1.2 |
| | | $KM_7$ | | 0.05 | | 6.49 | 2.45 | 18.35 | 2.93 | 0.09 | 0.24 |
| | | $M_6C$ | 1.85 | 2.02 | | 4.08 | 30.3 | 2.1 | 28.4 | 2.11 | 2.46 |
| | | $KM_6$ | | 2.38 | | 0.96 | 19.93 | 5.68 | 23.09 | 0.40 | 0.50 |

Each of the sintered mixed alloy A and B is an alloy in which Co of 3 wt % and Ni of 4 wt % are added to a 15Cr-3Mo alloy enriched with Cr, and $Cr_7C_3$-type carbide comes to equilibrium with the martensite parent phase. The sintered mixed alloy C contains increased amount of each of Mo and W so that $Cr_7C_3$-type carbide and $M_6C$-type carbide come to equilibrium with the martensite parent phase.

In table 2, each column of parent phase, $M_7C_3$, $M_6C$ show a concentration of each alloy element, a column of $KM_7$ shows a distribution coefficient of an alloy element M between a $Cr_7C_3$-type carbide and a parent phase (the distribution coefficient=(an amount (wt %) of an alloy element M contained in the $Cr_7C_3$-type carbide)/(an amount (wt %) of an alloy element M contained in the parent phase)) and a column of $KM_6$ shows a distribution coefficient of an alloy element M between a $M_6C$-type carbide and a parent phase (the distribution coefficient=(an amount (wt %) of an alloy element M contained in the $M_6C$-type carbide)/(an amount (wt %) of an alloy element M contained in the parent phase)). Comparison of such distribution coefficients of each alloy element shows characteristics of each alloy element.

Figure 6:
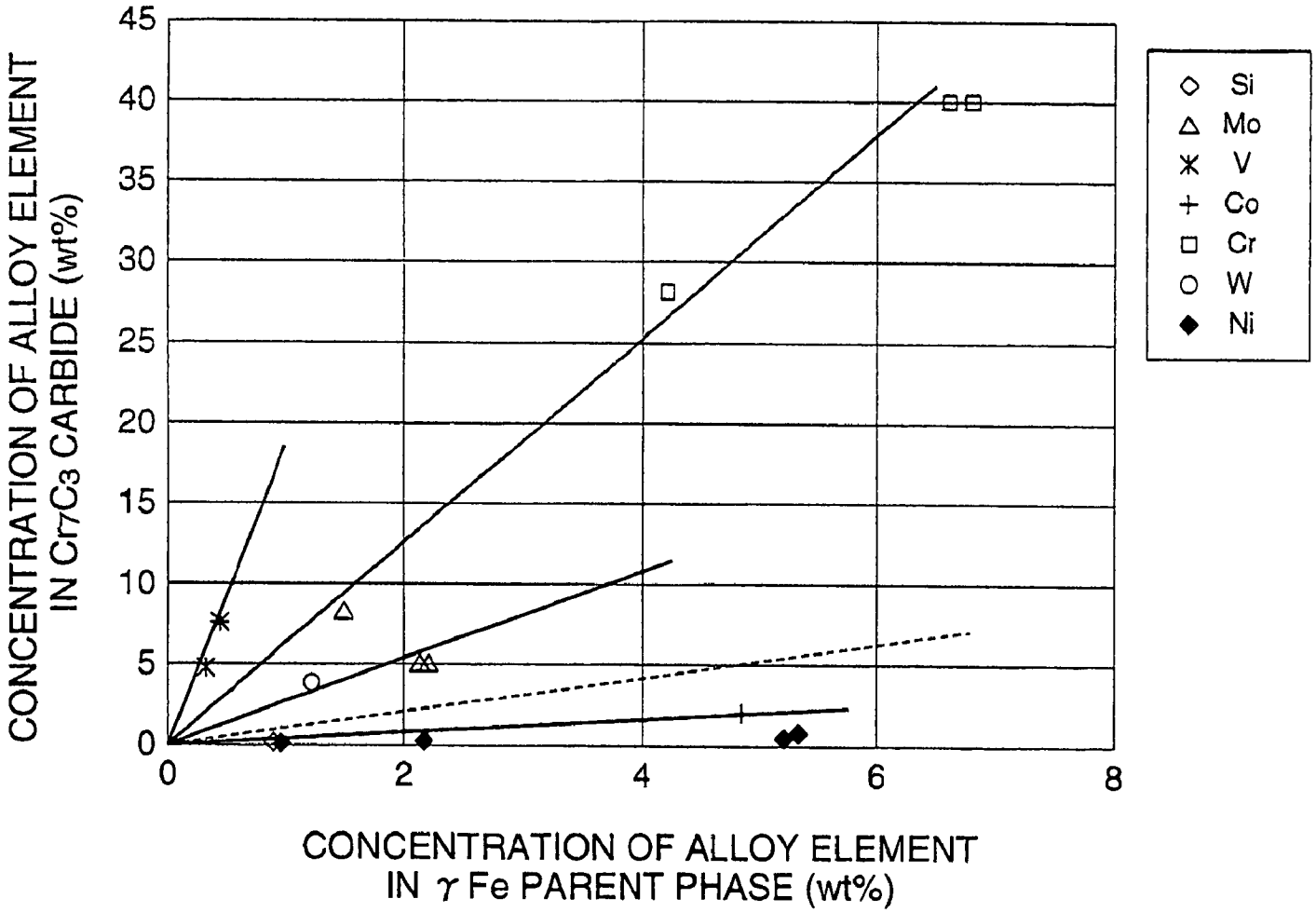
FIG. 6 is a graph showing a relation between concentrations of alloy elements contained in $Cr_7C_3$-type carbide and concentrations of alloy elements contained in a parent phase which comes to equilibrium with the $Cr_7C_3$-type carbide.
Figure 7:
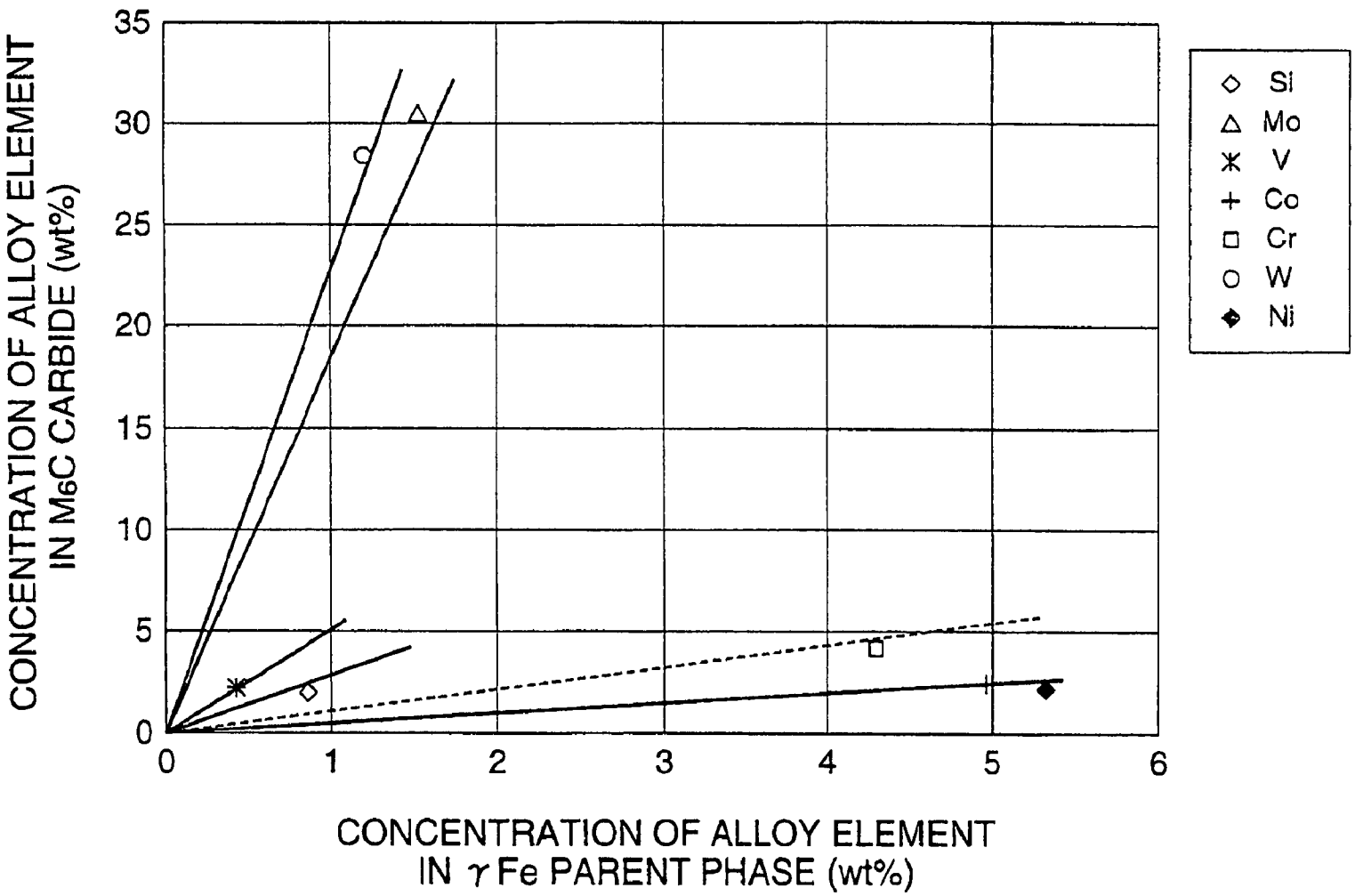
FIG. 7 is a graph showing a relation between concentrations of an alloy element contained in $M_6C$ type carbide and concentrations of alloy elements contained in a parent phase which comes to equilibrium with the $M_6C$ type carbide.

FIG. 6 is a graph showing a relation between concentrations of alloy elements contained in $Cr_7C_3$-type carbide and concentrations of alloy elements contained in a parent phase which comes to equilibrium with the $Cr_7C_3$-type carbide. And, FIG. 7 is a graph showing a relation between concentrations of an alloy element contained in $M_6C$ type carbide and concentrations of alloy elements contained in a parent phase which comes to equilibrium with the $M_6C$ type carbide. From the figures, it is found that each of alloy elements is distributed at an almost fixed ratio, and the sintered ferrous abrasion resistant sliding materials have almost the same distribution coefficient even if a composition thereof is different.

By means of such distribution coefficients, the following facts are shown quantitatively.

(1) Si and Al does not form a solid solution with $M_7C_3$-type carbide; almost all of Si and Al are concentrated in a martensite parent phase, enhancing tempering-softening resistance of the martensite parent phase.

(2) V is concentrated in $M_7C_3$ type carbide in a larger amount than Cr, Mo and W, and causes $Cr_7C_3$-type carbide to have a fine-grained structure. And, V is hardly concentrated in $M_6C$-type carbide. In a steel containing $M_6C$-type carbide and a martensite phase, V is precipitated as MC-type carbide, whereby tempering-softening resistance of the martensite phase is improved.

(3) Mo and W are concentrated in $M_6C$-type carbide more densely than $M_7C_3$-type carbide.

(4) Cr is remarkably concentrated in $Cr_7C_3$-type carbide; it is hardly concentrated in $M_6C$-type carbide.

(5) Ni and Co are concentrated in a martensite parent phase more than each carbide.

Typical SKD work tool steels and SKH work tool steels were quenched from a typical quenching temperature of the steel. Table 3 shows a composition of a martensite phase of each quenched steel and a content of carbide dispersed in each quenched steel, in which the composition was analyzed based of the distribution coefficient of each alloy element. The compositions are obtained by analysis of the X-ray micro analyzer and the contents of carbide are obtained by observing metallographic photographs. As shown in Table 3, the SKD steels (SKD1, SKD2, SKD11 and D7, a quenching temperature is 950° C.) have a martensite parent phase containing Cr of 6 to 7.5 wt % and carbon of 0.55 to 0.75 wt % and therefore containing $Cr_7C_3$-type carbide dispersed therein in 20% or less by volume. From a result, a concentration of carbon which forms a solid solution with the martensite parent phase is high, whereby heat crack resistance is insufficient compared with hot work tool steels (for example, SKD7, SKD6, SKD61 and SKD62) which require heat crack resistance. And also, since SKH steels (SKH2, SKH9) have a martensite phase which forms a solid solution with carbon of an large amount as 0.5 to 0.55 wt %, sufficient heat crack resistance cannot be achieved. In addition, since a content of hard special carbide dispersed in such steels is small, sufficient abrasion resistance compared with the high-carbon and high-Cr cast iron cannot be achieved.

TABLE 3

CONCENTRATIONS (wt %) OF ALLOY ELEMENT AND CONTENTS (% BY VOLUME) OF CARBIDES

| STEEL | | C | Si | Mn | Cr | Mo | W | V | Co | AMOUNT OF CARBIDE (% BY VOLUME) $Cr_7C_3$ | $M_6C$ | MC |
|---|---|---|---|---|---|---|---|---|---|---|---|---|
| SKD1 | COMPOSITION OF STEEL | 2.1 | 0.35 | 0.52 | 12.9 | | | | | 18% | | |
| | COMPOSITION OF PARENT PHASE | 0.7 | 0.43 | | 6.6 | | | | | | | |
| SKD2 | COMPOSITION OF STEEL | 2.08 | 0.32 | 0.53 | 12.7 | | 2.7 | | | 17% | | |
| | COMPOSITION OF PARENT PHASE | 0.7 | 0.4 | | 6.5 | | 2.1 | | | | | |
| SKD11 | COMPOSITION OF STEEL | 1.46 | 0.37 | 0.44 | 11.8 | 0.95 | | 0.31 | 3.48 | 12% | | |
| | COMPOSITION OF PARENT PHASE | 0.5 | | | 7.4 | 0.8 | | 0.14 | 3.8 | | | |
| D7 | COMPOSITION OF STEEL | 2.25 | 0.31 | 0.41 | 12.4 | 1.07 | | 4 | | 19% | | 1.60% |
| | COMPOSITION OF PARENT PHASE | 0.5 | 0.4 | | 6.3 | 0.82 | | 0.7 | | | | |
| SKD12 | COMPOSITION OF STEEL | 0.99 | 0.29 | 0.68 | 4.7 | 0.89 | | 0.39 | | 5% | | |
| | COMPOSITION OF PARENT PHASE | 0.7 | 0.3 | | 3.8 | 0.8 | | 0.25 | | | | |
| SKD61 | COMPOSITION OF STEEL | 0.38 | 1.02 | 0.39 | 4.8 | 1.2 | | 0.89 | | 0% | | |
| | COMPOSITION OF PARENT PHASE | 0.38 | 1.02 | | 4.8 | 1.2 | | 0.7 | | | | |
| SKD62 | COMPOSITION OF STEEL | 0.37 | 1.01 | 0.36 | 4.9 | 1.11 | 1.09 | 0.34 | | 0% | | |
| | COMPOSITION OF PARENT PHASE | 0.37 | 1.01 | 0.36 | 4.9 | 1.11 | 1.09 | 0.34 | | | | |
| SKH2 | COMPOSITION OF STEEL | 0.73 | 0.2 | 0.41 | 4.21 | 0 | 18.6 | 1 | | | 15% | |
| | COMPOSITION OF PARENT PHASE | 0.5 | 0.16 | | 4.3 | 0 | 4.3 | 0.6 | | | | |
| SKH9 | COMPOSITION OF STEEL | 0.89 | 0.26 | 0.42 | 4.49 | 4.73 | 6.72 | 2.5 | | | 12% | 1.30% |
| | COMPOSITION OF PARENT PHASE | 0.5 | 0.21 | | 4.5 | 1.45 | 1.8 | 0.7 | | | | |

NOTE)
$Cr_7C_3$ CARBIDE: CARBON OF 8.5 wt %, $M_6C$-TYPE CARBIDE: CARBON OF 2 wt %, MC-TYPE CARBIDE: CARBON OF 15 wt %,

Accordingly, in order to obtain a ferrous abrasion resistant sliding material having the same or more abrasion resistance as that of SKD work tool steels by dispersing carbide therein in 10% or more by volume and also having almost the same heat crack resistance as that of hot work tool steels, it is preferable that a concentration of carbon which forms a solid solution with a martensite phase is 0.5 wt % or less, more preferably 0.4 wt % or less.

In a case of a ferrous abrasion resistant sliding material formed by $Cr_7C_3$-type carbide and a martensite phase mainly, when a quenching temperature after sintering joining is set at 900 to 1000° C., in order to make a concentration of carbon which forms a solid solution with the martensite phase to be 0.2 to 0.5 wt %, it is necessary that an amount (wt %) of carbon with respect to an amount (wt %) of Cr, which is represented between two Tie-lines A and B represented in a phase diagram of a Fe—C—Cr ternary alloy at 900° C. (FIG. 1), satisfies the following equation;

$$0.143\times Cr(wt\ \%)-1.41 \leqq carbon(wt\ \%) \leqq 0.165\times Cr(wt\ \%)-0.41.$$

In FIG. 1, compositions in which $Cr_7C_3$-type carbide is dispersed in a content of 10, 20, 30, 40 and 50% by volume are represented at broken lines. From the figure, in order to disperse $Cr_7C_3$-type carbide in 10% by volume, Cr(wt %)≧10 wt %, and in order to disperse $Cr_7C_3$-type carbide in 50% or more by volume, Cr(wt %)≦40 wt %. And, it is preferable that a ferrous abrasion resistant sliding material contains $Cr_7C_3$-type carbide dispersed therein in a content of 20 to 50% by volume.

And, enhancing tempering-softening resistance of a martensite phase improves seizing resistance and abrasion resistance of a sliding surface to which earth and sand is entered under a boundary lubricating condition. Accordingly, it is preferable that the martensite phase has hardness of HRC50 or more, more preferably HRC55 or more even if quenched at a temperature of 600° C. And, each amount of alloy elements, which forms a solid solution with a martensite phase forming a solid solution with carbon of 0.15 to 0.5 wt %, are determined so as to satisfy the following equation using a tempering-softening resistant coefficient of each alloy element, $$26.2 \leqq 3\times(Si(wt\ \%)+Al(wt\ \%))+2.8\times Cr(wt\ \%)+11\times Mo(wt\ \%)+7.5\times W(wt\ \%)+25.7\times V(wt\ \%).$$

As shown in FIG. 1, a martensite phase contains Cr of about 7 wt % on the average and Si of about 0.3 wt %. From a result, for example, in order to compensate for insufficient tempering-softening resistance by using Mo only, it is necessary to add Mo of at least 0.5 wt %. From FIG. 2 (a phase diagram of a Fe—C—Mo ternary alloy), it is found that a maximum solid solubility of Mo is about 4 wt % (at 1000° C.). In addition, in view of an amount of Mo concentrated in $Cr_7C_3$-type carbide of a content of 10 to 40% by volume, a suitable addition amount of Mo is 0.6 to 6.5 wt %.

Figure 3:
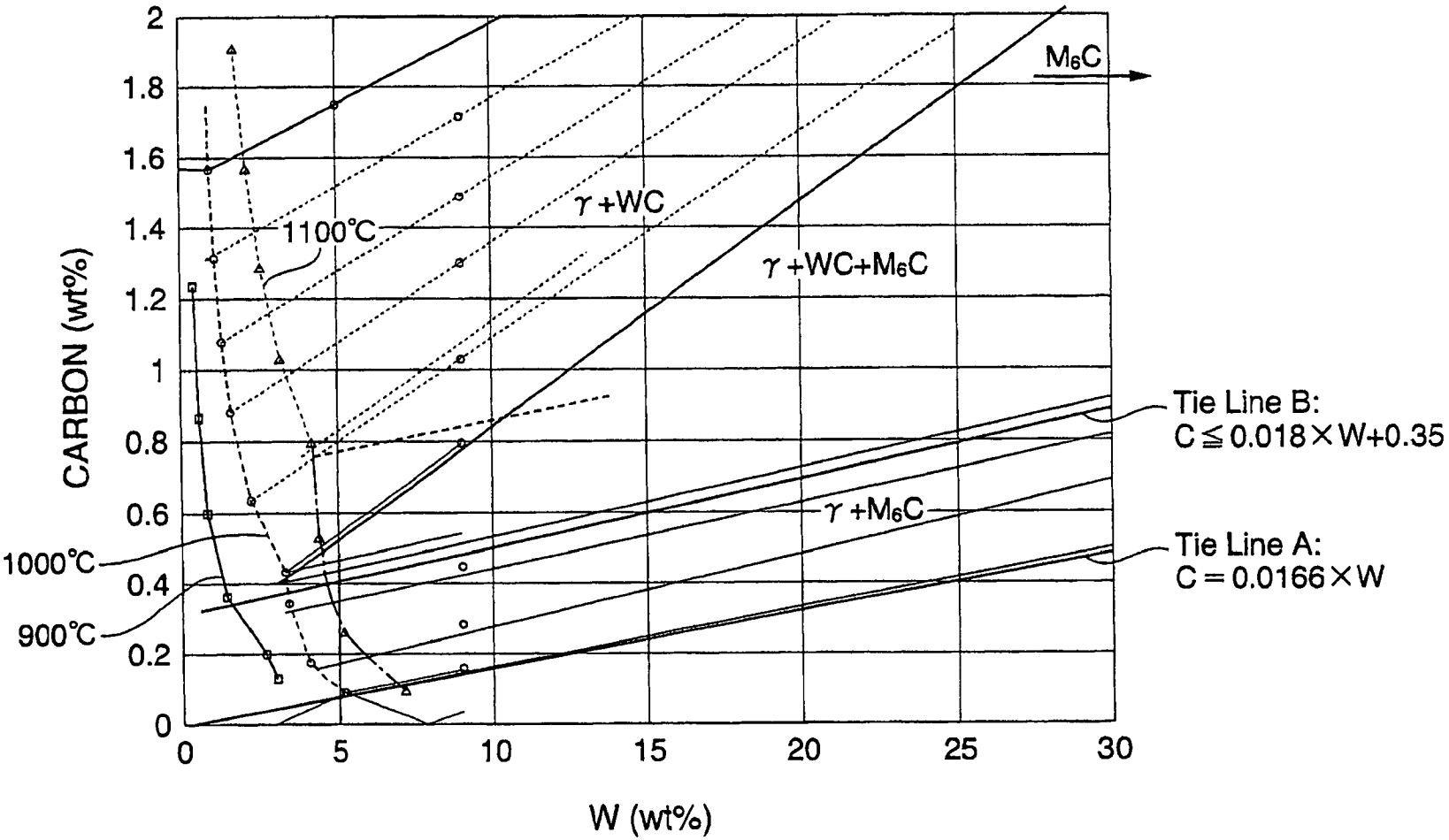
FIG. 3 is a phase diagram of a Fe—C—W ternary alloy (at 1000° C.).

In view of FIG. 3 (a phase diagram of a Fe—C—W ternary alloy), the same discussion as the above description is applied to W. As a result, an amount of each of Mo and W added to a ferrous abrasion resistant sliding material is 0.6 to 7 wt %. Especially, when a maximum solid soluble amount of each of Mo and W with a matrix phase is set at 2.5 wt % or less at which tempering-softening resistance is efficiently enhanced, it becomes possible to maintain each addition amount of Mo and W to be 4 wt % or less, and therefore it is economically preferred.

As described above, since V is concentrated in $Cr_7C_3$-type carbide and therefore V remained in a martensite phase decreases remarkably, it is not preferred as an element which increases tempering-softening resistance of a martensite phase. However, V works as a fine-grain formation of $Cr_7C_3$-type carbide. Accordingly, when a martensite phase of a ferrous sintered sliding material forms a solid solution of V of a maximum solid soluble concentration of 0.5 wt %, it is necessary to add V of 1.1 to 3.9 wt % ($Cr_7C_3$-type carbide of 10 to 40% by volume) thereto. And, in a ferrous sintered sliding material in which $Cr_7C_3$-type carbide is dispersed mainly, it is preferable from an economical viewpoint that an addition amount of V is maintained at 3 wt % or less.

In a SKH base sintered sliding material in which MC-type carbide in addition to MS-type carbide are dispersed, a solid soluble concentration of carbon with a martensite phase of the material is described in "J. Japan Inst. Metals" 2 (1963), P564, FIG. 3, "Change in Carbon Concentration in Matrix Accompanied with a Solid Solution of Carbide". For reference of the report, in order to regulate a solid soluble concentration of carbon to be 0.4 wt % or less easily, it is recommended that a quenching temperature after sintering joining is set at the range within 900 to 1100° C., which is more lower than a quenching temperature of a conventional SKH high speed steel of 1200 to 1350° C. Quenching in such a low temperature is one of the features of the present invention.

Figure 2:
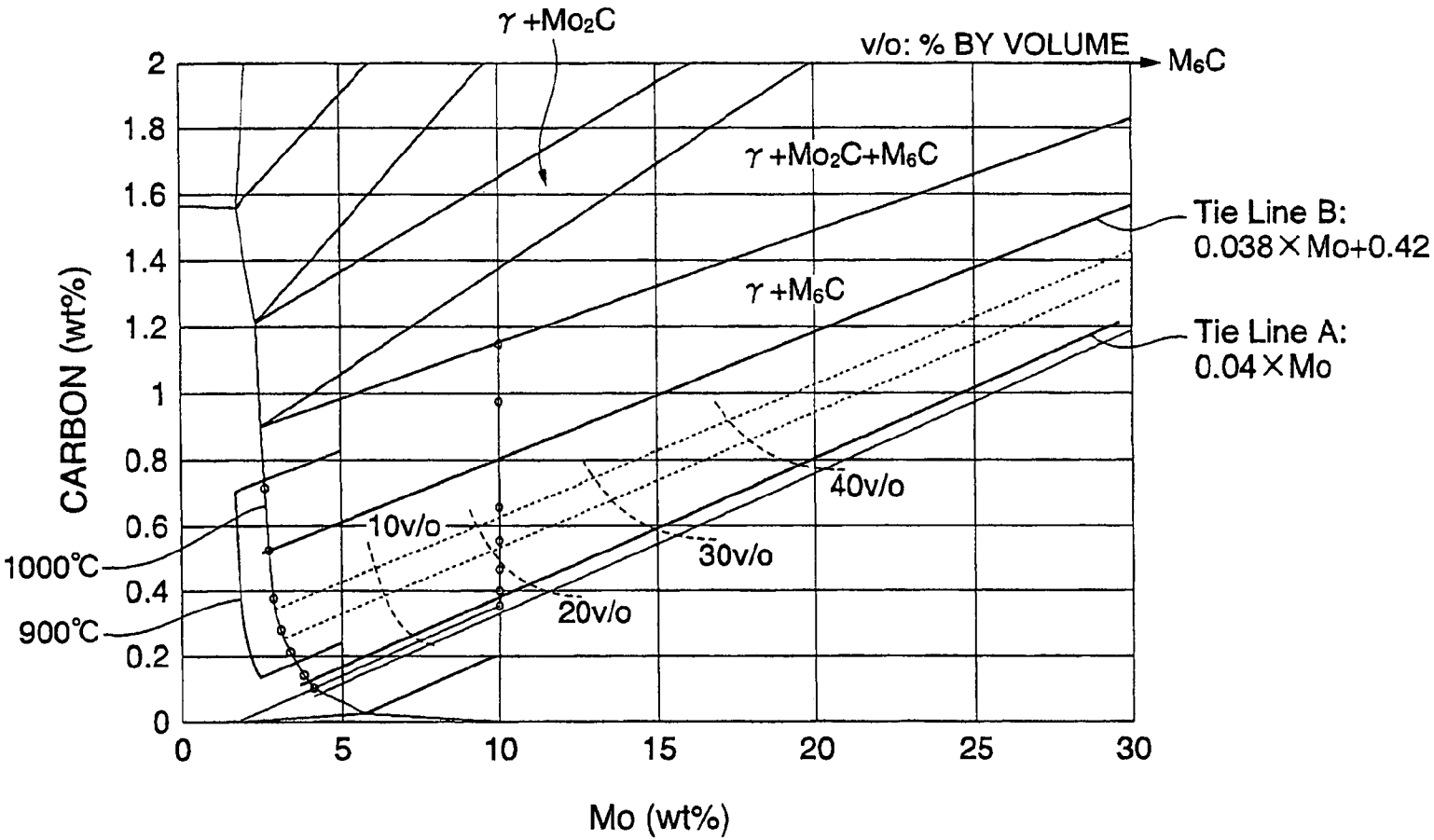
FIG. 2 is a phase diagram of a Fe—C—Mo ternary alloy (at 1000° C.).

Furthermore, the same discussion as the above description of a phase diagram of a Fe—C—Cr ternary alloy is applied to a phase diagram of a Fe—C—Mo ternary alloy as shown in FIG. 2 and a phase diagram of a Fe—C—W ternary alloy as shown in FIG. 3. Tie-lines A and B, passing 0.15 wt % and 0.4 wt %, respectively, each of which is a solid soluble concentration of carbon with a martensite phase equilibrium with $M_6C$-type carbide, are represented as mathematical formulas in the figure. As compared the Tie-line of a Fe—C—Mo ternary alloy with the Tie-line of a Fe—C—W ternary alloy, a gradient of the Tie-line of a Fe—C—W ternary alloy is about half of a gradient of the Tie-line of a Fe—C—Mo ternary alloy, and an amount (wt %) of Mo in the martensite phase equilibrium with $M_6C$-type carbide is almost equal to an amount (wt %) of W therein. From a result, when Mo is added coexistent with W, a equilibrium relation between compositions of $M_6C$-type carbide and a martensite phase is shown as 0.5×W(wt %)=Mo(wt %) from the phase diagram of a Fe—C—Mo ternary alloy. A suitable concentration (wt %) of carbon in a ferrous sintered sliding material, which is obtained by the mathematical formulas of the Tie-lines A and B, is shown in the following equation easily:

$$0.043\times(Mo(wt\ \%)+0.5\times W(wt\ \%)) \leqq carbon(wt\ \%) \leqq 0.038\times(Mo(wt\ \%)+0.5\times W(wt\ \%))+0.42.$$

From a result, it is preferable from an economical viewpoint that Mo is positively added and therefore an addition amount of W is maintained as small as possible. And, from the viewpoints in enhancing sinterability of a ferrous sintered sliding material and tempering-softening resistance of a martensite phase, Mo is a principal element to be added and W may not a necessary element to be added.

And, from distribution coefficients KM, of alloy elements such as Mo, W and Cr, it is possible to expect that Mo and W are added such that (Mo(wt %)+0.5×W(wt %)), in which 0.5×W(wt %) represents half of a real amount of W, is set at 6 to 20 wt % in order to disperse MC-type carbide in a content of 10 to 40% by volume.

EXAMPLE 2

Sliding Property of a Ferrous Abrasion Resistant Sliding Material

Figure 8:
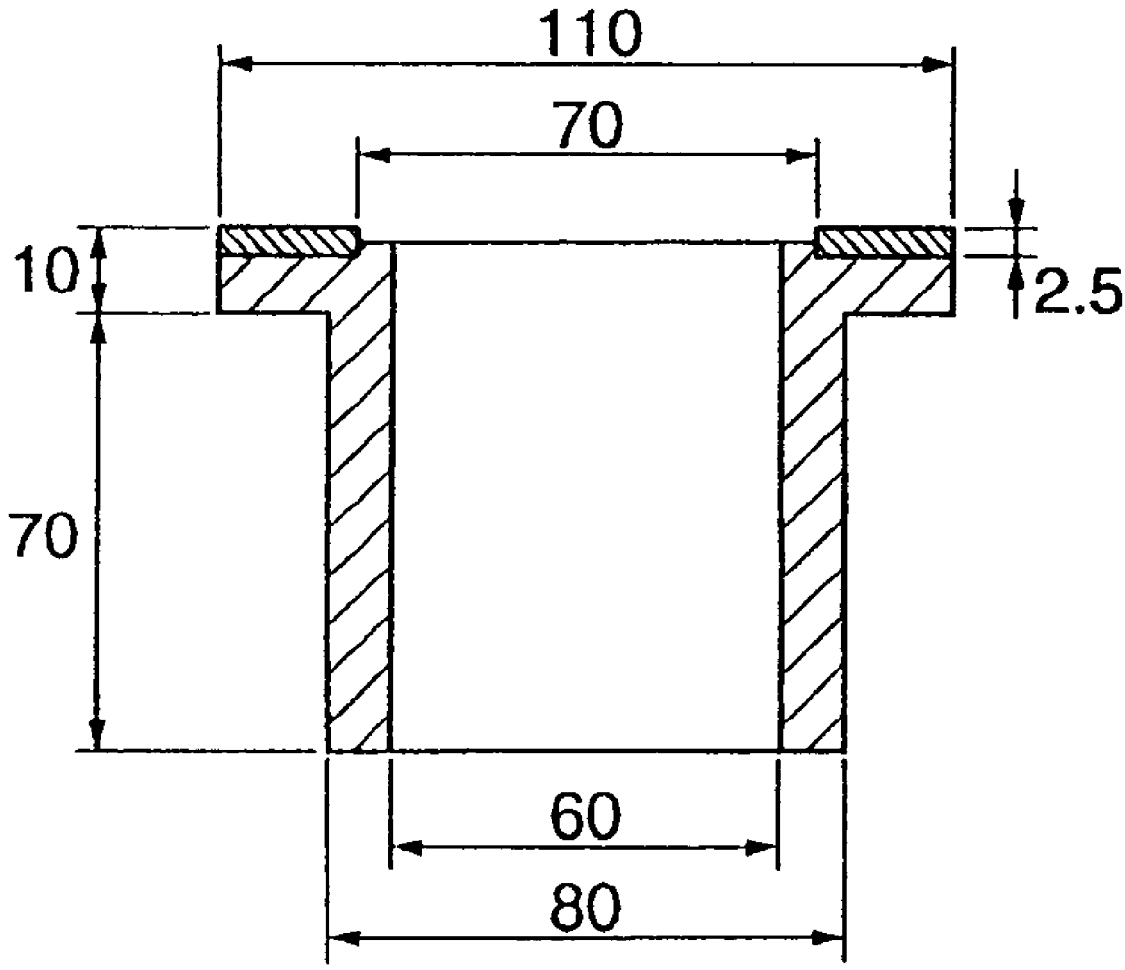
FIG. 8 is a cross sectional drawing a collar thrust bearing specimen.
Figure 9A:
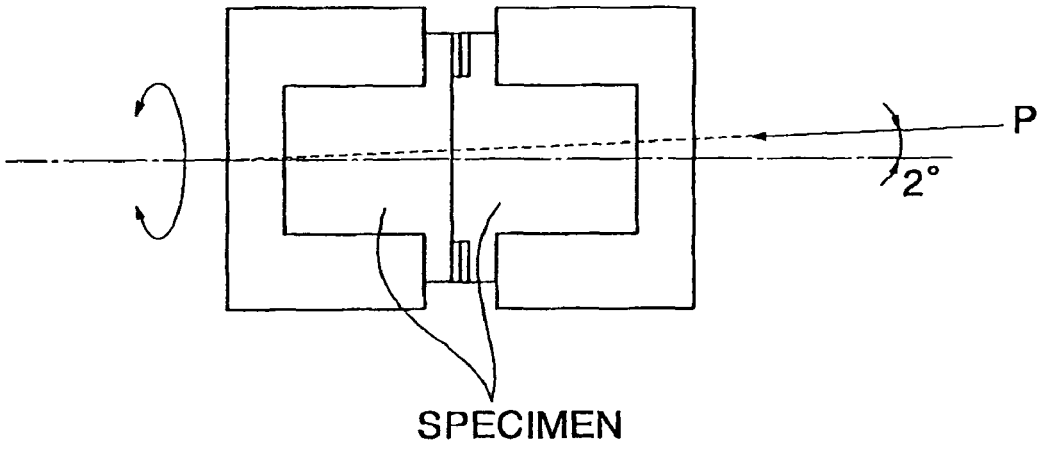
FIG. 9A and FIG. 9B are drawings showing an oscillating tester.
Figure 9B:
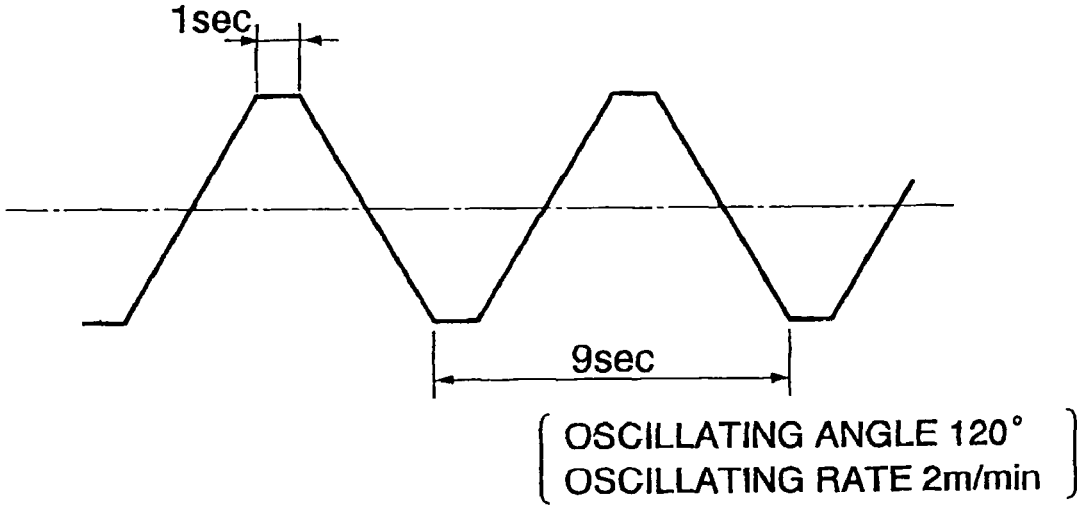

In this example, heat crack resistance and seizing resistance of a ferrous abrasion resistant sliding material were evaluated by an oscillating test using an oscillating tester shown in FIG. 9, in which one pair of specimens (collar thrust bearings) having a shape shown in FIG. 8 were contacted with the sliding surfaces thereof being faced each other, and kept being contacted in part at an oblique angle of 2°, and oscillated at an oscillating angle of 120° and an oscillating rate of 2 m/min. The oscillating test was carried out in such a manner that each specimen was oscillated being applied with a load (at a direction of P in FIG. 9A), each of which was incremented by 1 ton every 1000 times oscillation. The heat crack resistance and the seizing resistance were evaluated by using a load when heat crack or seizing occurred. For comparative specimens, thrust bearings made of SUJ2, SKD6, SKD11 and SKH9 which were conventionally quenched and tempered, and made of SCM420H steel which was carburized quenched and tempered at 930° C. so as to have a surface carbon concentration of 0.8 wt %, were prepared.

The ferrous abrasion resistant sliding materials as shown in table 4 were sufficiently annealed after forging and machined. Then, they were heated in a vacuum furnace at 960° C. for 2 hours and quenched by nitrogen gas cooling at 500 torr. And, after tempering at 200° C. for 2 hours, final polish treatment was applied to a sliding surface thereof. Each of the materials was fixed to a collar of S50C carbon steel to prepare a specimen shown in FIG. 9. In table 4, loads (ton) when heat crack or seizing occurs are also shown.

As a result of No 5 to No 8 alloys in which $M_6C$-type carbide is dispersed, as increase $M_6C$-type carbide and MC-type carbide, resistance of contact stress is more improved.

As compared No. 9 and No. 10 alloys in which MS-type carbide and $Cr_7C_3$-type carbide are dispersed by mixture with the comparative material 2, adjusting a solid soluble concentration of carbon with a martensite phase to be 0.2 to 0.5 wt % improves withstand load remarkably. And, from No 1 to No. 4 alloys, dispersing MS-type carbide together with $Cr_7C_3$-type carbide more improves resistance of contact stress.

From No. 11 to No. 17 alloys to which Si, Co, P, Al, Cu, (Al+Cu) and Ni are added, respectively, an addition of each element improves resistance of contact stress. Especially, an addition of Co, Al and (Al+Cu) improves resistance of contact stress remarkably. And, as shown in No. 17 alloy, increasing an addition amount of Ni increases a retained austenite phase in a parent phase, causing improvement in resistance of contact stress.

EXAMPLE 3

Floating Seal Property of Ferrous Abrasion Resistant Sliding Materials

In this example, each alloy shown in table 4 was cast by a centrifugal casting method to prepare a floating seal specimen

TABLE 4

SEIZING RESISTANCE AND ABRASION RESISTANCE
ton

| No. | C | Si | Mn | Ni | Cr | Mo | W | V | Co | P | Al | Cu | WITHSTAND LOAD | PV VALUE | ABRASION WIDTH (mm) |
|---|---|---|---|---|---|---|---|---|---|---|---|---|---|---|---|
| No. 1 | 2.21 | 0.61 | 0.87 | 2.01 | 16.6 | 2.3 | | 0.52 | | | | | 11 | 3.1 | 2.2 |
| No. 2 | 3.31 | 0.6 | 0.78 | 1.99 | 27.1 | 1.51 | | 0.5 | | | | | 15 | 3.5 | 1.6 |
| No. 3 | 4.39 | 0.58 | 0.81 | 1.91 | 36.1 | 1.82 | | 0.51 | | | | | 18 | 4.1 | 1.1 |
| No. 4 | 2.89 | 0.61 | 0.82 | 1.02 | 18.1 | 2.1 | | 3.31 | | | | | 13 | 3.6 | 0.9 |
| No. 5 | 0.72 | 0.51 | 1.02 | 2.03 | 5.2 | 10.1 | | 0.51 | | | | | 15 | 3.7 | 2.4 |
| No. 6 | 0.77 | 0.53 | 1 | 1.98 | 5.1 | 15.1 | | 0.52 | | | | | 17 | 4.1 | 2 |
| No. 7 | 0.91 | 0.53 | 1.03 | 1.99 | 5.13 | 20.1 | | 0.51 | | | | | 24 | 4.5 | 1.6 |
| No. 8 | 1.52 | 0.51 | 0.98 | 2 | 5.21 | 15.2 | | 3.52 | | | | | 18 | 4 | 1.2 |
| No. 9 | 1.73 | 1.52 | 0.83 | 2.11 | 9.01 | 6.21 | 4.12 | 2.5 | | | | | 20 | 3.6 | 2.5 |
| No. 10 | 3.08 | 0.56 | 1.51 | 0.01 | 15.1 | 10.1 | | 4.51 | | | | | 19 | 4.1 | 0.8 |
| No. 11 | 2.65 | 2.48 | 0.83 | 2.03 | 16.4 | 2.09 | | 0.51 | | | | | 17 | 3.6 | 1.9 |
| No. 12 | 2.35 | 0.59 | 0.85 | 2.04 | 16.7 | 3.51 | | 0.55 | 10.02 | | | | 26 | 4.3 | 1.6 |
| No. 13 | 0.82 | 0.52 | 0.78 | 2.02 | 5.07 | 15.3 | | 0.51 | | 0.52 | | | 21 | 3.7 | 2 |
| No. 14 | 2.41 | 0.64 | 1.52 | 3.01 | 16.9 | 2.26 | | 0.52 | | | 4.83 | | 28 | 5.1 | 1.2 |
| No. 15 | 2.29 | 0.65 | 0.84 | 0.07 | 16.3 | 1.12 | | 0.5 | | | | 9.86 | 14 | 3.9 | 1.8 |
| No. 16 | 2.25 | 0.47 | 1.51 | 3.08 | 16.7 | 1.21 | | 0.53 | | | 1.51 | 9.88 | 19 | 4.5 | 1.3 |
| No. 17 | 2.22 | 0.63 | 0.85 | 5.02 | 16.7 | 2.01 | | 0.5 | | | | | 16 | 3.8 | 2.6 |
| COMPARATIVE 1 | 3.51 | 1.58 | 0.52 | 2.02 | 16.8 | 2.41 | | 0.41 | | | | | 5 | 1.8 | 3.2 |
| COMPARATIVE 2 | 3.62 | 1.51 | 0.62 | 2.61 | 9.1 | 6.31 | 4.2 | 2.12 | 3.97 | | | | 6 | 2.3 | 2.3 |
| SUJ2 | | | | | | | | | | | | | 4 | | |
| SKD6 | | | | | | | | | | | | | 9 | | |
| SKD11 | | | | | | | | | | | | | 6 | 2.3 | 4.3 |
| SKH9 | | | | | | | | | | | | | 8 | 2.5 | 3.8 |
| SCM420 CARBURIZED | | | | | | | | | | | | | 4 | | |

As compared alloys of No. 1 to No. 4 with comparative material 1, adjusting a solid soluble concentration of carbon with a martensite parent phase to be 0.2 to 0.5 wt % improves withstand load remarkably. In addition, increasing $Cr_7C_3$-type carbide up to 20% by volume and precipitating $M_6C$-type carbide caused by adding V also improves withstand load.

Figure 10:
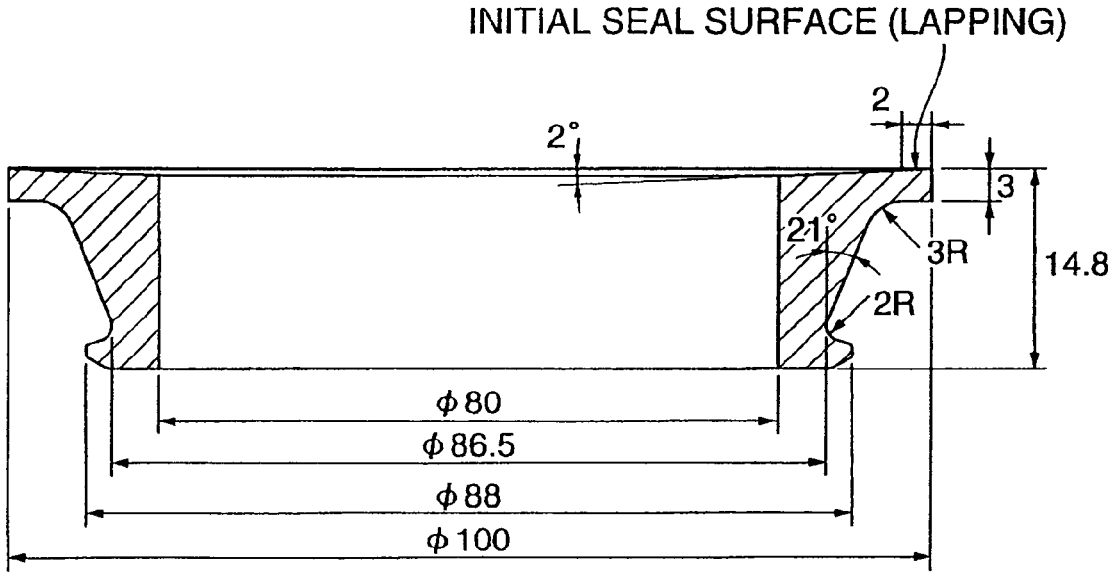
FIG. 10 is a cross sectional drawing showing a floating seal.
Figure 11:
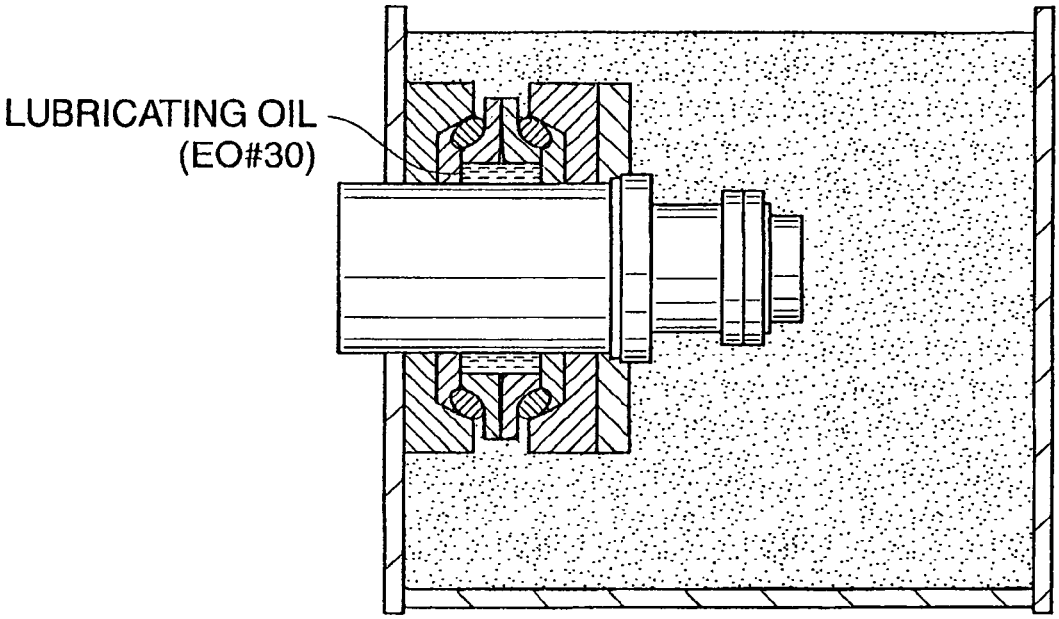
FIG. 11 is a drawing schematically showing a floating seal tester.

No. 1 and No. 5 alloys have the same solid soluble concentration of carbon with a martensite phase, and contain $Cr_7C_3$-type carbide and $M_6C$-type carbide dispersed therein in 20% by volume, respectively. Dispersing MC-type carbide more improves withstand load.

shown in FIG. 10. The floating seal specimens were cooled in a furnace at 960° C. and after maintained for 30 minutes, they were quenched under nitrogen gas atmosphere at 400 torr and then tempered at 200° C. for 2 hours. Then, after spherical grinding, a seal surface shown in figure was lapped for finishing. The floating seal specimens were evaluated in heat crack resistance, seizing resistance and abrasion resistance by using a sliding tester (a floating seal tester) shown in FIG. 11. The floating seal tester used a floating seal device, in which each of the prepared floating seal ring specimens was used as a pair of seal rings with the seal surfaces thereof contacted each other. And, an O-ring which pressed one of the seal ring was rotated around a central axis of the seal rings with respect to a fixed O-ring which pressed another seal ring with applying load.

The heat crack resistance and the seizing resistance were evaluated by using a revolution rate at which sliding resistance rapidly increased while changing a rotating rate (a revolution rate V) under a condition in which a seal load (a press pressure P=a load/a length in a seal surface) was kept at 2 kgf/cm in air with engine oil (EO#30) enclosed in the floating seal device. The abrasion resistance was evaluated by using a moving distance (abrasion width, mm) of a seal surface contact portion when the seal tester was operated at a press pressure of 2 kgf/cm and a revolution rate of 1 m/sec for 500 hours in water containing $SiO_2$ in about 50% by volume with engine oil (EO#30) enclosed in the floating seal device. The results are represented in "PV value" (P×V, kgf/cm·m/sec) showing heat crack resistance and in abrasion width in a right column of the table 4.

Each of the alloys as shown in table 4 has a PV value having substantially the same tendency as a critical load (withstand load, ton) evaluated in Example 2. Adjusting a solid soluble concentration of carbon with a martensite parent phase to be 0.2 to 0.5 wt % improves seizing resistance.

As compared an abrasion width of each of the comparative materials 1 and 2 which are widely used for a floating seal in a construction machine, the alloys according to the present invention in which $Cr_7C_3$-type carbide is dispersed in a content of 20% or more by volume has sufficient abrasion resistance. Especially, the alloys to which V is added and MC-type carbide is dispersed therein have excellent abrasion resistance. On the contrary, the comparative materials 1 and 2 show remarkable adhesion abrasion.

What is claimed is:

1. A ferrous abrasion resistant sliding material having a martensite parent phase which forms a solid solution with carbon, wherein the material comprises carbon of 1.5 to 3 wt %, Cr of 7 to 25 wt % and (Mo+0.5×W) of 6 to 15 wt %, in which 0.5×W represents half of a real amount of W, with each amount being satisfied the following equation;

$0.043\times(Mo(wt\ \%)+0.5\times W(wt\ \%))+2\times 0.085\times(Cr(wt\ \%)-5)\leqq carbon(wt\ \%)\leqq 0.038\times(Mo(wt\ \%)+0.5\times W(wt\ \%))+0.42+2\times 0.085\times(Cr(wt\ \%)-5)$, and wherein the martensite parent phase forms a solid solution with carbon of 0.2 to 0.45 wt % and comprises $Cr_7C_3$ carbide and $M_6C$ carbide precipitated and dispersed therein in a content of 5 to 25% by volume and in a content of 5 to 25% by volume, respectively wherein M is Cr, Mo, W or V.

2. The ferrous abrasion resistant sliding material according to claim 1, wherein said material further comprises V of 3 wt % or less.

3. The ferrous abrasion resistant sliding material according to claim 1, wherein said material further comprises P of 0.2 to 1.5 wt %, and comprises one or more phosphides selected from the group consisting of $Fe_3P$, $Cr_2P$, FeMoP, $V_2P$ and FeTiP dispersed therein in a total content of 0.5 to 10% by volume.

4. The ferrous abrasion resistant sliding material according to claim 1, wherein said material further comprises one or more elements selected from the group consisting of Si, Al, Ni and Co in a total content of 2 to 15 wt %.

5. The ferrous abrasion resistant sliding material according to claim 4, wherein said material further comprises Si of 0.5 to 3.5 wt %.

6. The ferrous abrasion resistant sliding material according to claim 1, wherein said martensite parent phase further comprises Al of 3 to 15 wt % and has order transformation.

7. The ferrous abrasion resistant sliding material according to claim 1, wherein said material further comprises a copper alloy phase dispersed therein in a content of 1 to 10% by volume.

* * * * *